United States Patent [19]

Swain

[11] 4,252,297

[45] Feb. 24, 1981

[54] TRANSPORTER LIFTER

[75] Inventor: C. Daniel Swain, Tacoma, Wash.

[73] Assignee: Comerco, Inc., Tacoma, Wash.

[21] Appl. No.: 28,862

[22] Filed: Apr. 10, 1979

[51] Int. Cl.[3] ..... B63C 13/00

[52] U.S. Cl. ..... 254/8 R; 414/495; 414/498

[58] Field of Search ..... 414/495, 498, 608; 254/8 R, 8 B, 8 C, 6 R, 6 B, 6 C, 133

[56] References Cited

U.S. PATENT DOCUMENTS 3,802,006 4/1974 Nelson et al. ..... 414/495 X

*Primary Examiner*—Robert C. Watson

*Attorney, Agent, or Firm*—Gipple & Hale

[57] ABSTRACT

A moveable cart for transporting structures which are adapted for mounting upon a wall rail. The cart is constructed with a roller linkage assembly pivotally mounted to a wheeled frame and a deck mounted on the linkage assembly. The deck is engaged by the rollers of the linkage assembly so that the vertical position of the deck can be moved with regard to the wall rail, allowing a modular cell structure placed on the deck to be carried upward or downward. A rack driven gear locking assembly is rotatably mounted to the deck. The gear locking assembly is engaged by a rack assembly which is driven by the roller linkage assembly so that it rotates against the sides of the structure to hold the structure in a fixed position during the transportation and vertical positioning of the deck.

23 Claims, 20 Drawing Figures

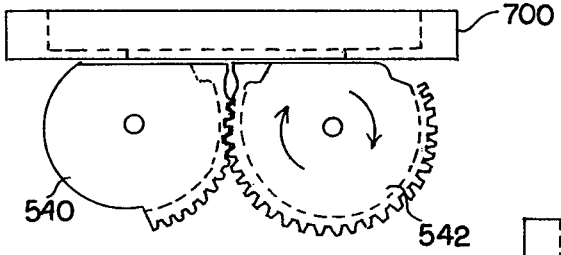
Fig. 11
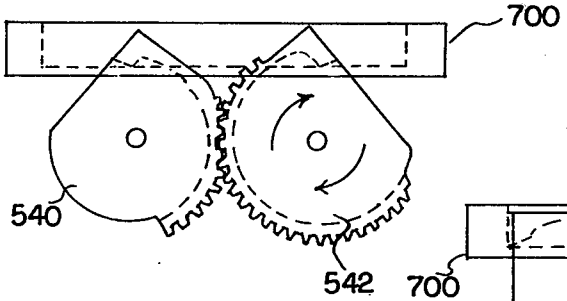
Fig. 12
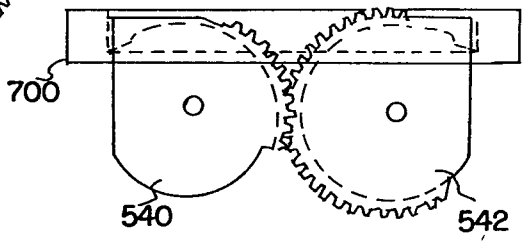
Fig. 13
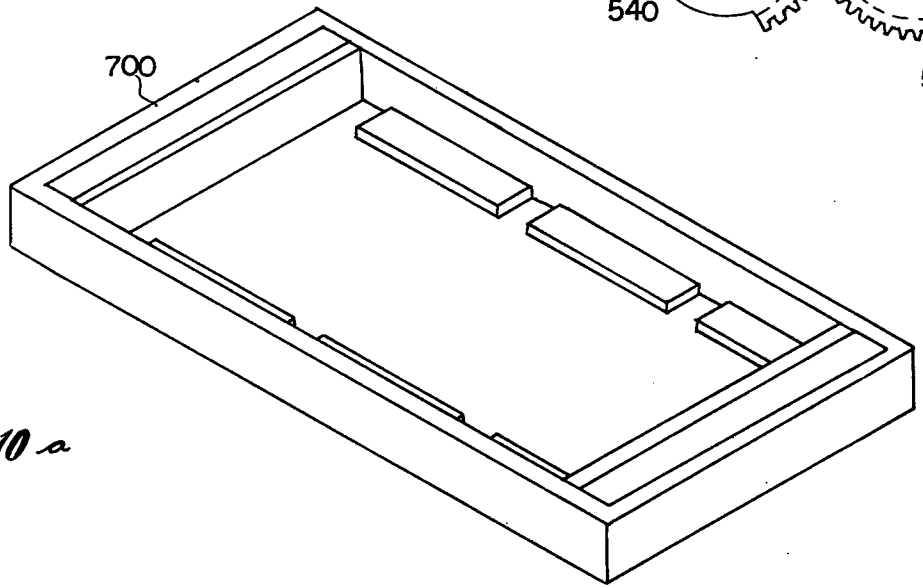
Fig. 10-a

TRANSPORTER LIFTER

BACKGROUND OF THE INVENTION

This invention generally relates to the field of transporting unitary modular cell units which are useful in organizing and storing smaller items. The modular cell units serve in a similar capacity to a storage cabinet, but are employed in a hospital setting for the storage of a patient's personal belongings, clothing or medicines.

A modern hospital faces unique and expensive problems in health care and sanitation. Hospitals provide a multitude of services, each requiring improvement and each threatened by rising costs and obsolescence. Distribution of products and sanitizing medical equipment and furnishings frequently result in duplicating waste, destruction of property, theft, loss, and other problems. In order to provide good economical service, a hospital must have uniform sanitary procedures and controls. Previously, "unsanitizable" structures included most furniture, complex professional equipment, transporting devices, containers and storage units which could not easily be carried by hand. All hospital items, without exception should and need to be clearly accessible for removal of contaminated materials and for sterilization. In regard to furniture and storage devices, there should theoretically not be any seams, cracks, interior grooves, hinges, and unsealed shell interiors penetrable by air or liquid flow in order to preserve a sanitary atmosphere. With rare exception, present structures do not lend themselves to these requirements.

In operating a hospital, it has increasingly become apparent that visible physical characteristics of the patient's room or surroundings can have a profound impact on the psychological outlook of the patient. It is also well established that a happy patient generally feels physically better than an unhappy one. These obvious conclusions dictate a style for a designer of hospital equipment and furniture.

In order to be esthetically pleasing to the patient while maintaining functionality, a system of unitary modular cell units is utilized which is transportable for sanitation purposes. Each individual cell unit is capable of storing a plurality of items of various shapes and sizes in an esthetic and sanitary manner. Each cell unit is constructed of a hard, resilient, and durable plastic which allows the units to be molded as one solid piece, eliminating unsightly seams which substantially decreases the degree of impurities maintained in the structure after sterilization. Elimination of seams also tends to increase a cell unit's structure rigidity.

A plurality of cell units are used in the patient's room, which units are secured to the wall of the room by being attached to a wall rail which is fastened to the room wall at an appropriate height. The modular cell unit is secured to the wall by means of a mounting key which fits in the wall rail and is held by both by the unit's rear surface and the rail wall. As the modular units are removeable from the wall, they can be sterilized each and every time a new patient occupies a particular room. This obviuosly leads to a sanitary hospital environment in addition to preventing the transfer of disease or germs from patient to room articles to a new patient.

Additionally, the modular cell units are provided with drawers, pull trays, or shelves which slide in and out of the front of the cell unit. These storage drawers, shelves, or pull trays can be mixed and matched to provide a variety of cell unit configurations. Quite obviously, the flexibility of the units take on a plethora of functional embodiments and are a tremendous advantage to a hospital. The cell doors, shelves, or pull trays are also constructed of heavty-duty plastic and therefore, can be sterilized after removal. The system is washable and made of tough, resilient plastic so that it is able to withstand vigorous washing. The cell unit is without seams, does not have sharp corners, and is provided with drainage holes to allow water to easily drain from it so that is can be used with industrial washers for sanitation purposes.

One problem in using such large varied cell units is that the cell units must be transported from the area of use to a sanitation area or to another area. Various attempts to move such equipment have been tried by the obvious expedience of having orderlies or other individuals hand carry the structures to the sanitation area. This form of transportation is extremely costly in labor costs and insurance costs, as well as the inherent cost of damage which occurs through handling and abuse of the structures. Since the cell units are mounted on a wall rail, they have to be lifted up from the wall rail and if not hand carried to the sanitation area, placed on a cart or dolly to be trucked away to the desired area. This type of handling also causes great destruction to the units and to the trays and shelves located within the units. In addition, the units often are orientated on the handtruck so that they can tip over or fall from the hand truck. In loading a cart or hand truck, the modular cell unit has to be physically lifted by the individual from the wall rail, which lifitng requires several individuals with the attendant result of possible injuries to the individual and breakage of the units and/or their components.

Such wall mounted structures have been envisioned as being moved by forklift trucks with the operator of the truck inserting the forks into slots formed into the structures and lifting the structures off of the rail and carrying them to the sterilizing area. However, it is readily apparent that special fork mounts have to be provided on the structures which utilize a great deal of material and waste a lot of space in the hospital room. In addition, space for maneuvering such a vehicle is generally not available, so that the physical lifting requirement is again required in order that the item can be placed on the fork lift truck. In addition, the forks of the trucks quite often bang into the plastic and cause serious damage of the structures.

The present invention overcomes the prior art problems by utilizing a cart which is pushed beneath a structure and operated by a foot pedal to lift the modular cell unit off of the rail while simultaneously holding the unit in a locked position on the bed of the cart. It can readily be seen that this feature is extremely important, not only in the removal of the unit from the rail, but also in the placement of the unit on the rail. Thus, the cellular modular unit is fixedly held on the cart for vertical movement, so that items may be placed in the unit and lifted up onto the rail without displacement or destruction of internally held articles. Thus, a single individual can easily remove a heavy modular cell unit from its wall rail or place the modular cell unit on the wall rail without regard to the mass or strength of the person and transport the modular unit to any area so that a sanitary environmentally sound hospital room can be provided for the patient.

SUMMARY OF THE INVENTION

The present invention pertains to a cart having a wheeled frame with a vertically displaceable deck. The deck is vertically positioned by a foot pedal and linkage mechanism which engages the bottom of the deck to force the deck upward into a position in which the modular cell unit is lifted above the support rail raising the modular cell unit off of the rail and locking it into a fixed position. The locking is accomplished by locking members being driven upward by the action of a rack into the bottom of the modular cell unit engaging the inner sides of the walls to hold the cell unit in a fixed position. A second pedal means is provided on the deck to release the rack-driven locking mechanism.

BRIEF DECRIPTION OF THE DRAWINGS

An understanding of the present invention will become apparent upon consideration of the following detailed description of specific embodiments thereof, especially when taken in conjunction with the accompanying drawings, in which:

FIG. 10(*a*) is a perspective view of the bottom section of a modular cell unit;

FIG. 11 is a cross-sectional view showing action of the gear locking mechanism with respect to the bottom section of the modular cell unit of FIG. 10(*a*);

FIG. 12 is a sequential view of FIG. 11 after activation by the rack mechanism;

FIG. 13 is a sequential view of FIG. 12 showing the locking gear mechanism engaging the sides of the modular cell unit shown in FIG. 10(*a*);

DETAILED DESCRIPTION OF THE DRAWINGS

Figure 2:
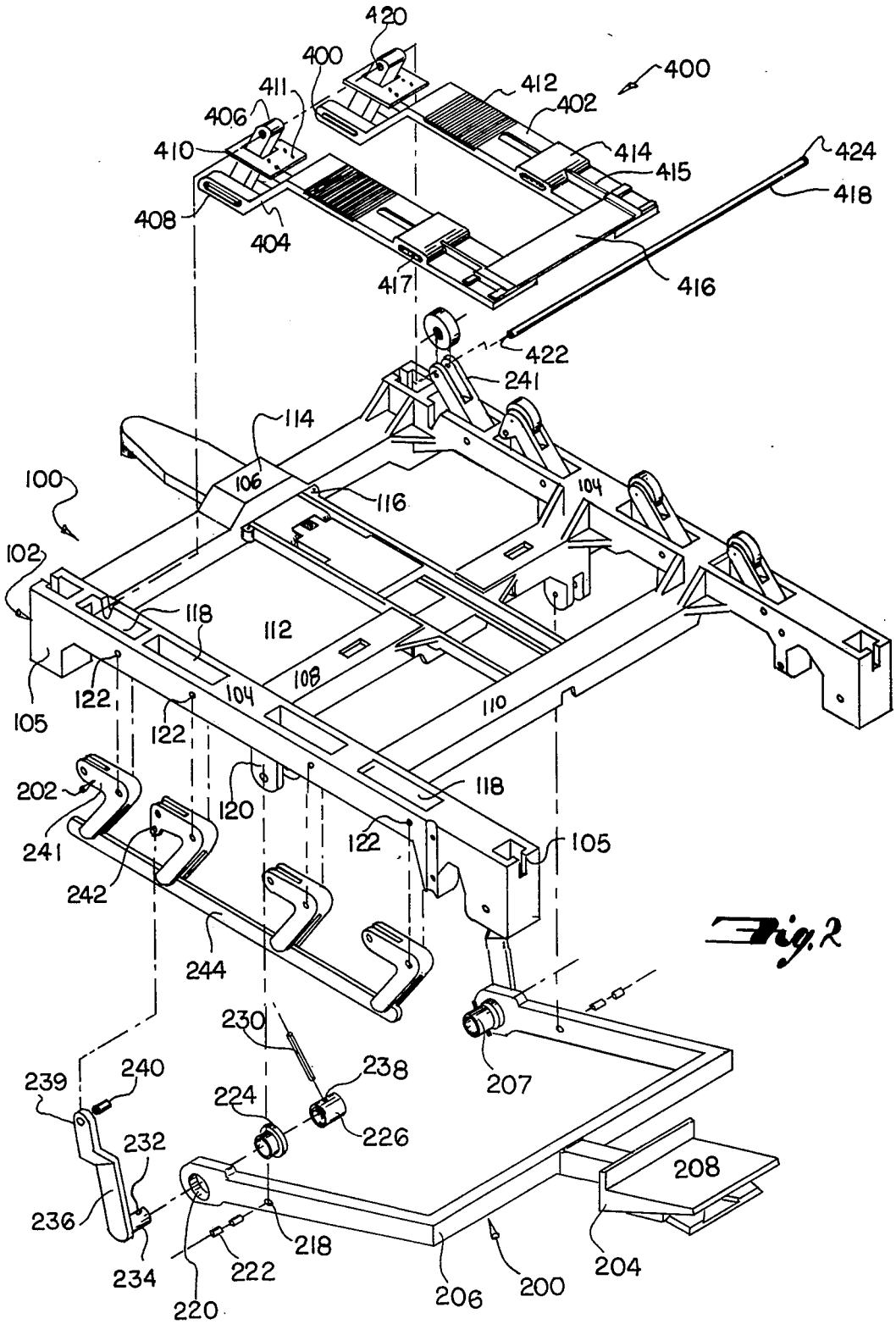
FIG. 2 is an exploded perspective view of the lifting assembly mechanism and support frame of the cart shown in FIG. 1.

The present invventive cart is shown by FIGS. 1 through 19. In the invention, a frame assembly 100 as best shown in FIG. 2 is constructed with a solid integral molded plastic frame 102. The frame comprises a pair of parallel legs 104 defining on each end a sleeve 105 adapted to receive a standard castor or wheel assembly 124. The legs are joined together by a forward support member 106, an intermediate support member 108, and a rear support member 110.

A track member 112 is integrally connected to the three support members and terminates at the forward and rear members 106 and 110. The forward support member 106 defines a raised support extension 114 formed on its upper surface and located at approximately the mid-point of the member with a through-going slot 116 which is axially aligned with track 112 and is adapted to receive a tongue assembly 300, which will be discussed later on in the specification.

Each of the parallel legs 104 defines a plurality of through-going rectangular apertures 118 which are adapted to receive a roller pivot arm 250 of roller linkage subassembly 202 and is also provided with ears 120. The ears 120 are adapted to hold a lever arm 206 for pivotal rotation thereon. Through-going apertures 122 are formed in the legs 104 for communication with the rectangular through-going apertures 118. The apertures 122 are axially aligned with apertures 258 of the roller pivot arms 250 allowing the pivot arms to be pivotally seated within the rectangular apertures.

Figure 3:
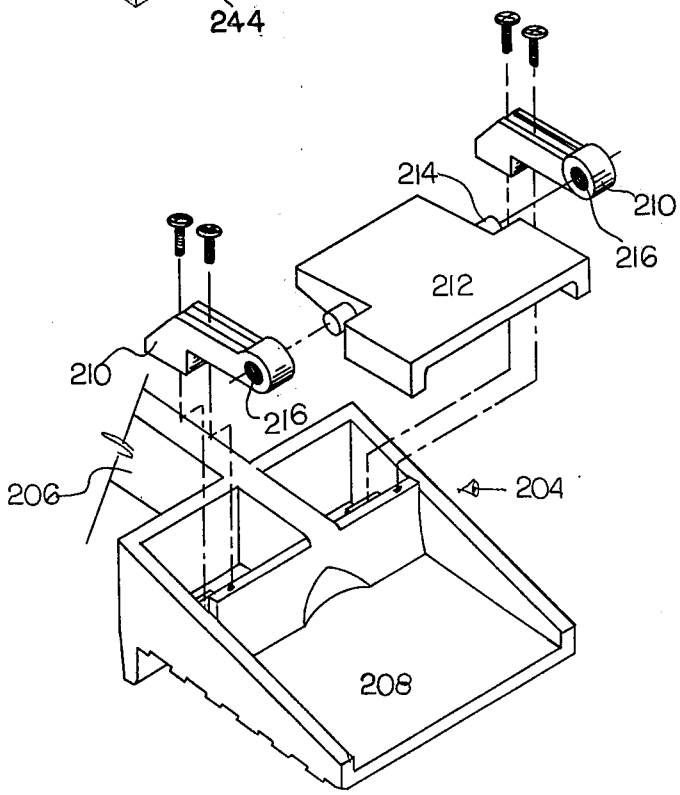
FIG. 3 is an enalrged exploded bottom view of the foot pedal shown in FIG. 2.

A lever arm subassembly 200 is mounted to the frame 102. The lever arm subassembly 200 has a yoke-shaped lever member 206 with a tongue saddle lever pedal 204 secured to one end. The tongue saddle lever pedal 204 as best shown in FIG. 3 comprises a lever arm member 208 secured to the lever member 206, a pair of bracket members 210 screwed to the arm member 208 and a tongue saddle member 212 having outwardly extending pins 214 mounted in apertures 216 formed in the bracket members 210. The lever member 206 defines two apertures 218 and 220 in each arm of the yoke. Aperture 218 receives a bushing 222 allowing it to be secured for rotation by pin means (not shown) in ears 120. The other aperture 220 receives a flanged bushing 224 to receive a support pipe 226 which is provided with aperture 238 for receiving roll pins 230. Each roll pin 230 holds the support pipe in position between the arem os the yoke member 206 by being inserted through through-going aperture 232 of the male member 234 extending from connector bar 236 and apertures 238 of the support pipe. The assembled relationship of the parts is best seen at assembly 207 of FIG. 2. The other end of the connector bar 236 is provided with an aperture 239 adapted to receive a bushing 240. This bushing fits between the slot 251 of roller pivot arm 250 and is held in position by suitable pin means inserted through aperture 242.

Figure 4:
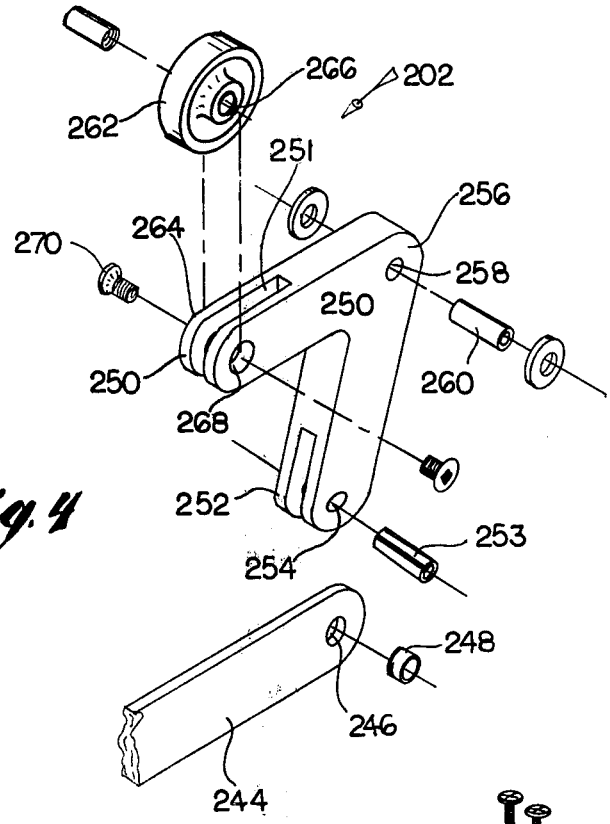
FIG. 4 is an enlarged exploded view of one of the rocker arms and associated rollers of the lifting assembly mechanism shown in FIG. 2.

The roller linkage subassembly 202 as shown in FIG. 4, comprises a transfer bar 244 formed with a plurality of apertures 246 adapted to receive bushings 248. A "L" shaped roller pivot arm 250 is provided with a yoke at each end. End 252 is provided with apertures 254 which are co-axially aligned with apertures 246 of the transfer bar 244, so tht it can be fastened in positon with a roll pin 253. The base 256 of the "L" shaped pivot arm is provided with an aperture 258, which is adapted to receive nylon bushing 260. The aperture 258 is aligned with apertures 122 of the parallel arms 104 of the frame so that the pivot arm 250 can be pivotally mounted on the frame. A nylon roller 262 is rotatably mounted on end 264 of the arm 250 by aligning the aperture 266 of the roller 262 with the counter sunk threaded apertures 268 formed in end 264. A bushing may be threaded into the apertures 268 or screws 270 may be used to hold the roller 262 in position.

Figures 1, 5, 10:
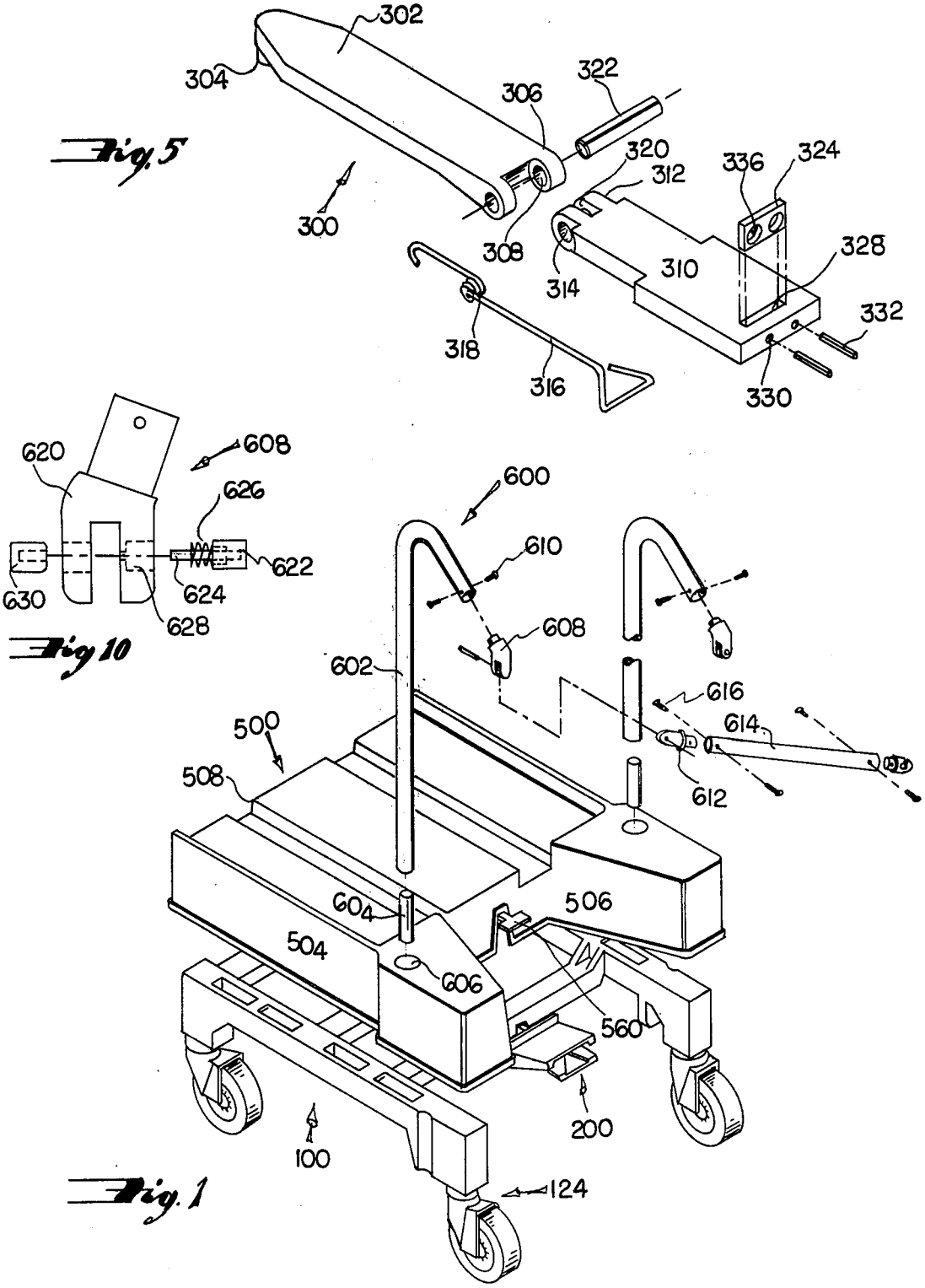
FIG. 1 is an exploded perspective view of the cart invention.
FIG. 5 is an enlarged exploded perspective view of the hitch assembly shown in FIG. 2.
FIG. 10 is an enlarged exploded elevational view of the handle sockets shown in FIG. 1.

A slidable tongue subassembly 300 as best shown in FIG. 5, is slid into track 112 of the frame through slot 116 of the member 114. The tongue assembly comprises a tongue member 302 having pin shaped attachment stop 304 extending from one end with the other end of the tongue member forming a yoke 306 with apertures 308. An anchor block member 310 is provided with a smaller yoke 312 having apertures 314, the yoke 312 being designed to fit within the yoke 306 so that its apertures 314 are coaxially aligned with the apertures 308 to receive a press roll pin 322. A tongue support spring 316 having a coil 318 is inserted in slot 320 formed by the yoke 312 of the anchor block member. The press roll pin 322 is inserted through the yoke apertures 308 to hold the tongue support spring in place. The spring 316 biases tongue member 302 with respect to anchor member 310. A stop member 324 having through-going apertures 336 is inserted into a slot 328 formed in the anchor block body. Apertures 330 are formed at the end of the anchor block member 310 and extended inward perpendicularly and communicate with slot 328. Thus, it can be seen that roll pins 332 can be inserted in the apertures 330 and hold stop member 324 in position within slot 328.

A track top plate (not shown) is fastened to the top of the track with screws.

A rack sub-assembly 400 is mounted to the roller pivot arms 241. Rack sub-assembly 400 comprises two members 402 having off-set ends 404 forming yokes 408. The ends of the yoke define through-going aperture 409. A lever rod 406 is mounted in each yoke by a pin going through the through-going apertures 409 and an aperture formed in one end of the lever rod. A fulcrum pad 410 is mounted over the lever rod and is provided with a plurality of apertures 411 allowing it to be secured to bosses 516 of the cart deck by means of screws 520. Each of the off-set rack members comprises a rack section 412 and a channel forming structure 414 which is adapted to receive rack supports 524 secured to bosses 514 extending outward from the bottom of the cart deck. The rear ends of the off-set rack members 402 are secured together by the channel forming structure 414. A slide support shaft 418 is inserted through apertures 420 in the lever rods 406, and also is mounted through apertures 268 of pivot arm 250 and roller aperture 266, so that roller 262 is rotatably supported thereon. The slide shaft 418 is threaded at ends 422 and 424 to receive screws 270 which hold the slide shaft in place on the assembly.

Figure 6:
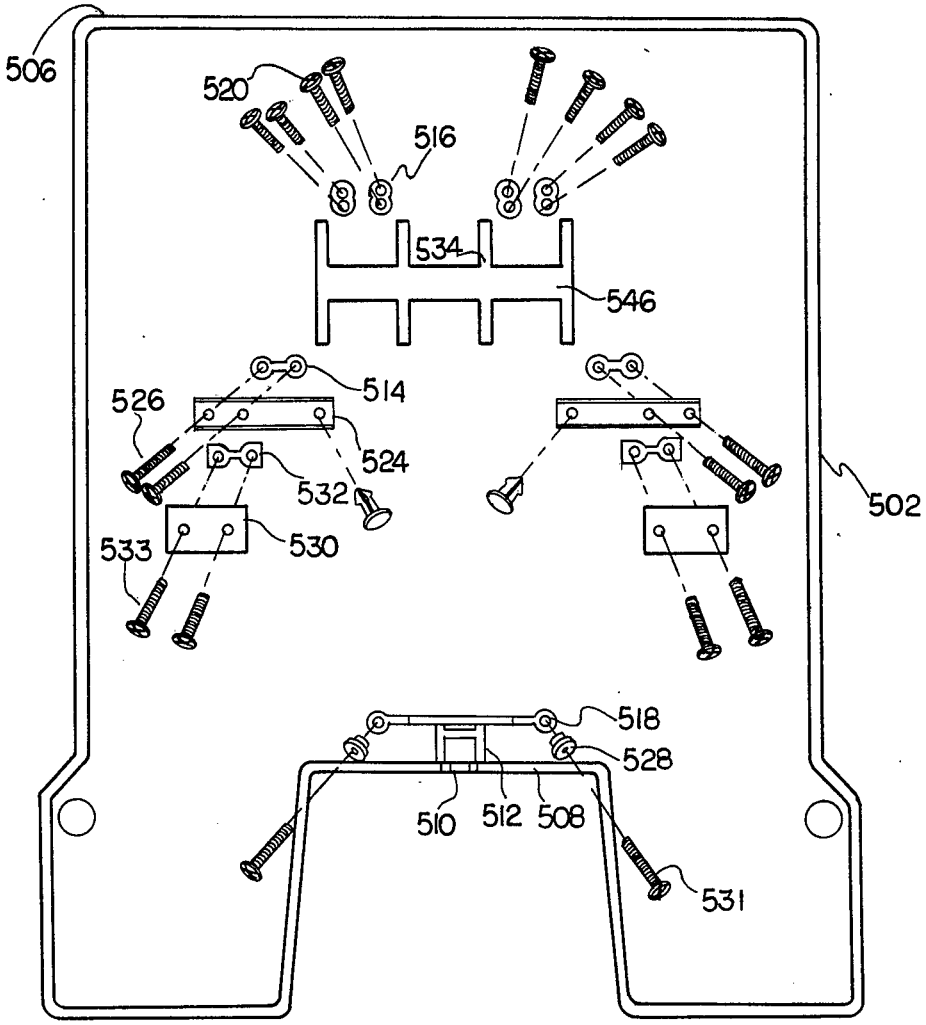
FIG. 6 is a bottom plan view of the carriage shown in FIG. 1 with fastener elements partially removed.

The cart deck assembly 500 comprises an integrally formed plastic cover 502, the top surface which is shown in FIG. 1 and the bottom surface which is shown in FIG. 6. The frame is formed with downwardly extending side walls 504, a downwardly extending front wall 506 and a downwardly extending rear wall 508. The rear wall 508 is slotted at 510 to receive a release arm mechanism 560 and is provided with a seat 512 which holds a rotatable roll pin 568. A plurality of bosses 514, 516, 518, and 532 extend outward from the bottom surface of the deck.

The bosses 516 are adapted to be aligned with apertures 411 of the fulcrum pads 410, so that screws 520 with their respective lock washers can be used to secure the fulcrum pads in a secured position to the bosses.

The bosses 514 are used to secure rack supports 524 which are mounted onto the bosses 514 by screws 526. The rack supports 524 extend through channel 417 formed in structure 414.

The bosses 518 serve to receive bushings engaging ridge 415 of each member 402 to keep the rack assembly in position, so that it does not bind or drag on the nylon bushings.

Figure 9:
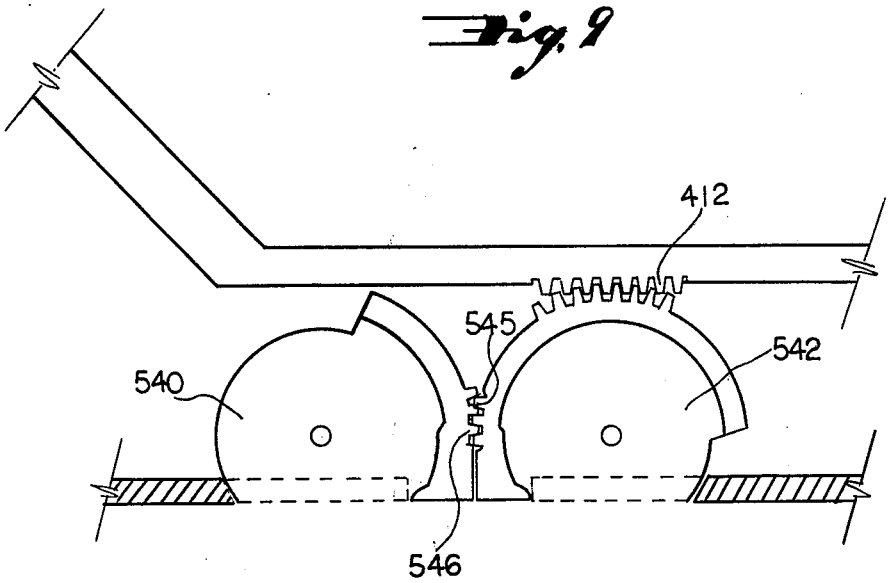
FIG. 9 is a cross-sectional view showing the gear locking mechanism in engagement with the rack mechanism.
Figure 8:
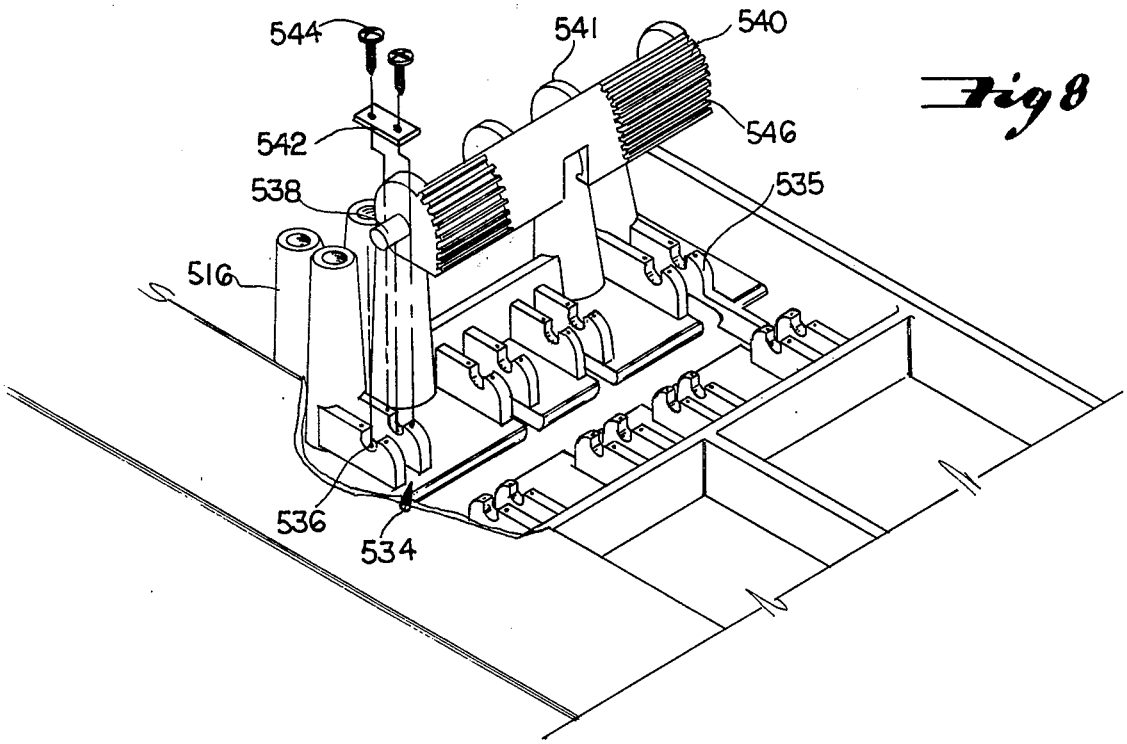
FIG. 8 is a perspective view of a gear mechanism mounted to the bottom of the cart carriage and adapted to be driven by the rack mechanism.
Figure 14:
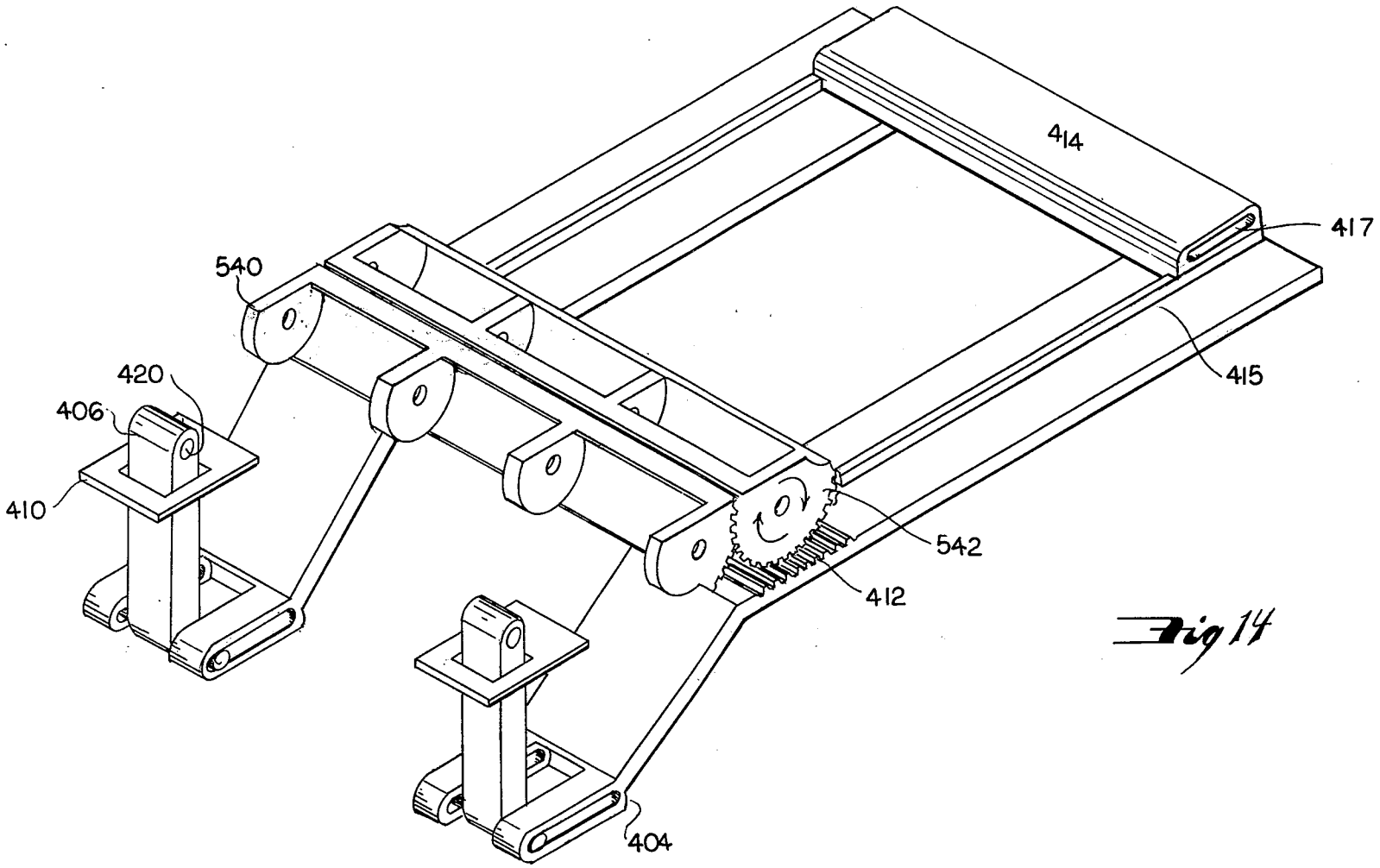
FIG. 14 is a perspective view of the rack and gear mechanisms isolated from the cart structure.

Retainer plates 530 are mounted on bosses 532 which extend from the lower surface of the cart body to position the rack assembly. The plates are secured therein by screws 533. A plurality of seats 534 are formed in the cart deck, which seats are better seen in FIG. 8. These seats are constructed of two shaped members 535 with notches 536 which are adapted to receive a support bar 538 of geared clamp member 540. Each seat is spaced apart to receive a guide member 541 of a gear member. Saddle plates 542 are secured to seats 534 by screws 544, so that the geared clamp member 540 can be rotatably mounted and driven by the rack section 412 through its driving action on geared clamp member 542. The geared clamp member 542 is provided with gear teeth 544, which engage gear teeth 546 to drive both clamp members upward through slot 546 so that the clamp members engage the edge of the wall of the modular cell unit 700 lockking it in position as best shown in FIG. 13. While it is noted that the teeth orientation of FIG. 9 differs with that of FIGS. 11 and 13, the action of the gear members is the same. The preferred embodiment is shown in FIG. 9 and the alternate embodiment shown in FIGS. 11–13.

Figure 7:
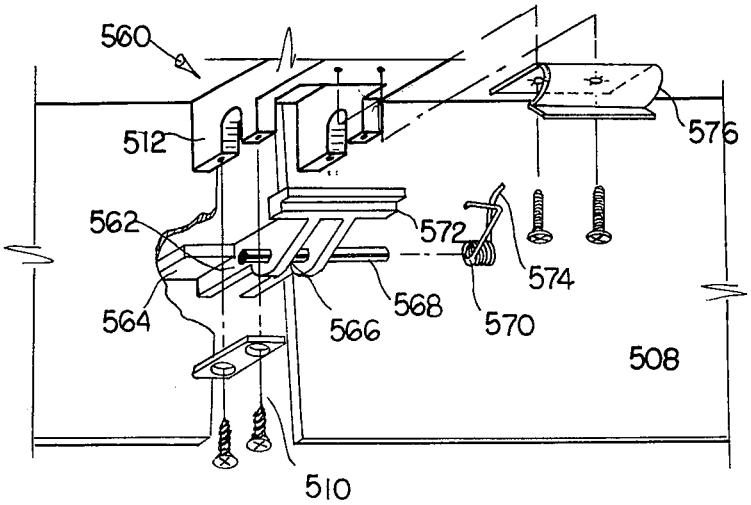
FIG. 7 is an exploded perspective view partially in cross-section of the locking rack mechanism shown in FIG. 1.

A lock release arm mechanism 560 as shown in FIGS. 1 and 7 is rotatably mounted in seat 512, the release mechanism comprising a lock release arm 562 having a pedal 564 which extends outside of the cart deck. The arm 562 defines a plurality of apertures 566 through which a rotatable rod 568 is inserted. The rod 568 also holds a tension spring 570 in position so that one end of the spring engages end 572 of the lock release arm and the other end of the spring 574 engages the inner surface of the rear wall of the cart deck. A retainer clip 576 is mounted to the cart deck to retain the rear surface of the rack in position.

A handle mechanism 600 is used on the cart for use by an individual to propel it around. The handle mechanism comprises an inverted "J" shaped hollow handle 602, which is mounted on a handle sleeve 604 inserted in aperture 606 formed in the outer top surface of the cart deck. A handle knuckle 608 is secured to the handle 602 by screw means 610. The handle knuckle is designed to engage a cross bar knuckle 612 which is secured to cross bar 614 by screw means 616. The handle knuckle 608 as best seen in FIG. 10 comprises a knuckle 620 having a spring button 622 with a roll pin 624 spring mounted and seated in the spring button through the action of compression spring 626. A stepped bore 628 is cut in the knuckle to seat the roll pin and the spring button with a lock button 630 being provided which is seated in a chamber formed in the knuckle to engage and hold the roll pin in a fixed position.

Figure 15:
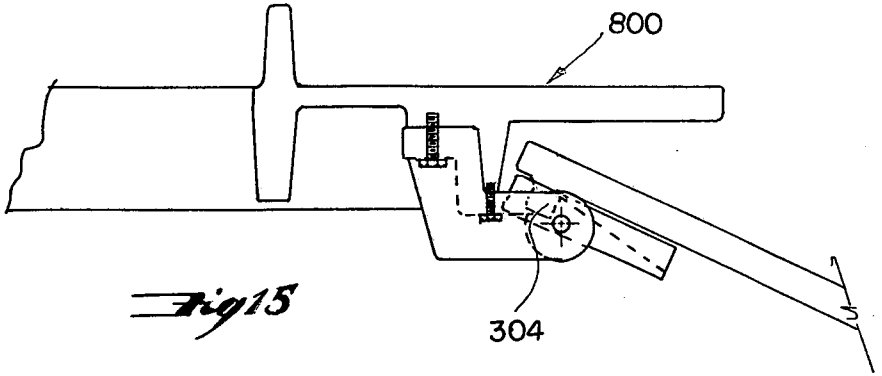
FIG. 15 is a partial side elevational view partially in cross-section of the tongue locking assembly of the mechanism.
Figure 17:
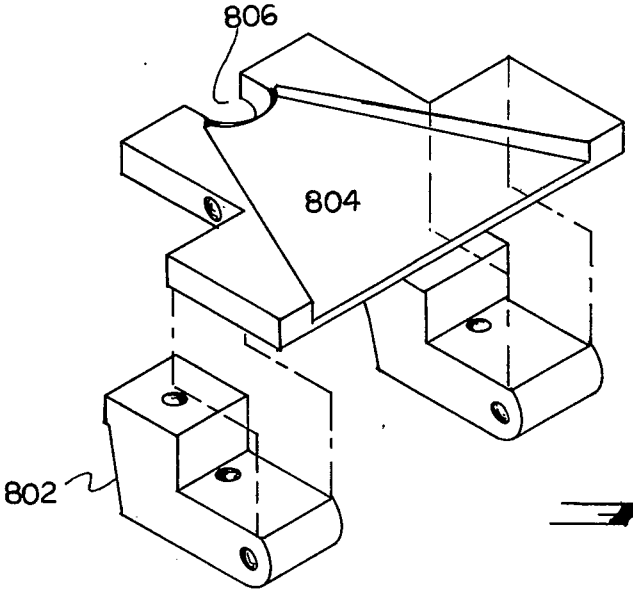
FIG. 17 is an exploded perspective view of the mechanism shown in FIG. 15.
Figure 16:
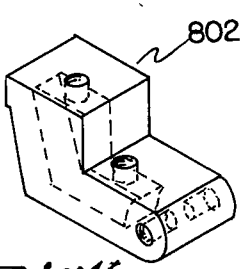
FIG. 16 is a perspective view of one locking member shown in FIG. 15.
Figure 19:
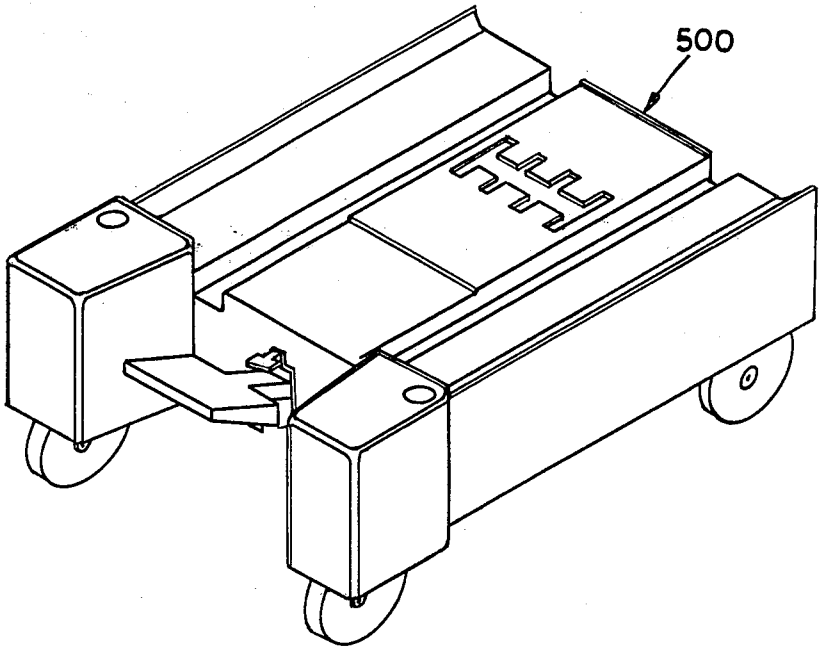
Figure 18:
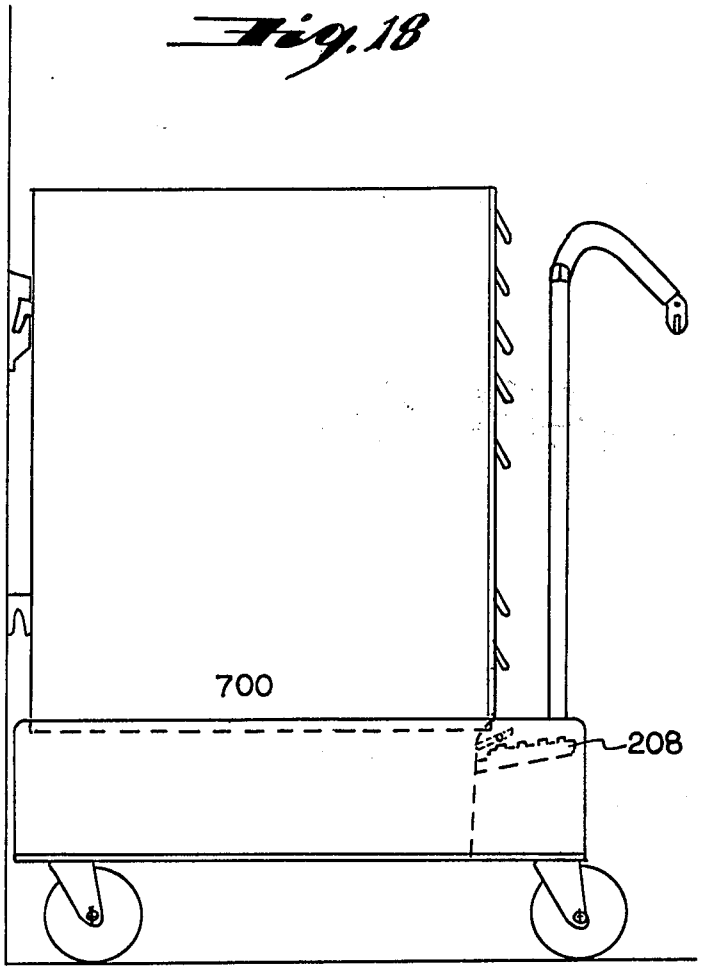
FIG. 18 is a side elevational view of the cart with a modular cell unit loaded thereon; and, FIG. 19 is a perspective view of the innovative cart.

The cart can be pulled in a train by means of the coupler 212 or an alternate coupling mechanism 800 which is shown in FIGS. 15–17. Coupling mechanism 800 comprises mounts 802, corresponding to members 210, which are secured to the cart deck and a channeled guide member 804 defining aperture 806. The channeled guide member is pivotally secured to the mounts 802 and the aperture 806 is configured to hold tongue projection 304. In the preferred embodiment the tongue projection 304 is held by the rear wall of member 212.

In operation of the cart, the cart is brought under the cabinet or modular cell unit 700 which is mounted or desired to be mounted upon the wall. The pedal 208 is then stepped upon by the operator causing the lever arm 206 and respective roller linkage to rise upward lifting the cart deck and causing the rack sub-assembly to be driven, so that it engages the lock release arm and is locked in position. Simultaneously the rack drive clamps 540 through the action of clamp member 542 are driven upward through slot 546, so that the ends of each of the clamp member rotates until they abut against the sides of the modular cell unit 700, as shown in FIGS. 11–13. The modular cell unit is thus clamped in an elevated position so that it can be readily removed from the rack on which it is mounted. When desired, the release arm pedal is then stepped on by the operator which disengages the rack so that the cell unit is no longer held in a locked position allowing it to be removed from the cart as desired. As previously noted, the cart, through the tongue sub-assembly and coupling mechanism, can be interconnected together to form a series of cars in a train so than any number of the materials can be moved back and forth.

While the preferred embodiment of the invention has been disclosed, it is understood that the invention is not limited to such an embodiment since it may be otherwise embodied in the scope of the appended claims.

What is claimed is:

1. A moveable cart for transporting a structure and vertically lifting the structure for placement on a wall comprising a wheeled support frame, coupling means mounted to said support frame, lifting means pivotally mounted to said support frame, said lifting means comprising a yoke shaped lever member with a pedal means at one end pivotally mounted to said frame and a roller linkage assembly comprising a transfer bar and a plurality of pivot arms mounted to said transfer bar, said roller linkage assembly being mounted to said lever member so that movement of the pedal member causes the lever member to lift the pivot arms upward, each of said pivot arms being provided with roller means mounted thereon, said roller means when lifted upwards engaging a deck structure positioned above said support frame, said deck structure defining a throughgoing aperture therein and having a plurality of rotatable locking members mounted thereon, said locking members being mateably engaged with a rack means which is moveably connected to said roller linkage assembly so that movement of the lever arm drives the pivot arms upward so that the rollers engage the deck and the rack means is driven against the locking members rotating the locking members to project upwardly through said aperture against a structure mounted on said deck locking it to a fixed position, said locking members comprising a plurality of rotatable members, said members including at least one driver member and a driven member, said driver member being provided with gear teeth which mateably engage to said rack and are driven by said rack, and gear teeth which mateably engage teeth of said driven member to drive said member when acted upon by said rack.

2. A moveable cart for transporting structures having the capability of lifting said structures for placement upon a wall, comprising a wheeled support frame, lifting means pivotally mounted to said support frame, a deck mounted to said support frame, said deck being adapted to be engaged by said lifting means to vary the vertical position of the deck with regard to the frame and means to engage a structure mounted on said deck and lock it into a fixed position; said lifting means comprising a lever arm means mounted to said frame,, a pedal mounted to said level arm means, linkage means connected to said lever arm means, said linkage means comprising a transfer bar and a plurality of pivot arms mounted to said transfer bar; each of said pivot arms including roller means rotatably mounted thereon.

3. A moveable cart as claimed in claim 2 wherein said locking means comprises rack means moveably mounted to said frame and toothed locking members moveably mounted to said deck, said locking members mateably engaging said rack and adapted to be driven by said rack.

4. A moveable cart as claimed in claim 2 wherein said frame comprises two leg members adapted to receive wheels and a plurality of intermediate support members connecting and supporting said leg members, each of said leg members defining a plurality of apertures therein suitable to allow pivot means to rotate therethrough and an intermediate member positioned between said two legs, said intermediate member having connecting means slideably mounted therein.

5. A moveable cart as claimed in claim 4 wherein said connecting means comprises a tongue member and a anchor member connected to said tongue member, said tongue member and anchor member being slideably mounted in track means defined by said intermediate member, said tongue means being further provided with coupling means porjecting therefrom.

6. A moveable cart as claimed in claim 5 wherein said anchor member is provided with stop means therein, said stop means being positioned on said anchor means to limit horizontal movement along said track means.

7. A moveable cart for transporting structures, said cart having the capability of lifting a structure for placement upon a wall rail and comprising a wheeled support frame, lifting means pivotally mounted to said support frame, a deck structure mounted to said support frame, said deck structure defining a throughgoing aperture therein and holding a plurality of rotatable locking members, said locking members being matably engaged with rack means which is moveably connected to said lifting means so that movement of said lifting means drives said rack means against said locking members causing said locking members to project upwardly through said aperture against a structure mounted on said deck locking it into a fixed position.

8. A moveable cart as claimed in claim 7 wherein said frame comprises a pair of parallel legs defining sleeve means on each end, said sleeve means being adapted to receive a wheel assembly, a plurality of support members connected to said legs and a track member mounted to said support members, at least one of said support members being provided with a throughgoing aperture which is axially aligned with the track member, each of the parallel legs defining a plurality of throughgoing apertures which are adapted to receive linkage means.

9. a moveable cart of claim 8 including tongue means mounted on said track member, said tongue means comprising a tongue member having stop means extending from one end and an anchor member connected to said tongue member, said anchor member and tongue member being engaged by spring means which biases said tongue member, said tongue member being pivotally connected to said anchor member and slidably mounted on said track member, said anchor member being provided with means to limit the movement of said tongue means along said track member.

10. A moveable cart as claimed in claim 7 wherein said lifting means comprises a lever arm sub-assembly, a roller linkage sub-assembly mounted to said lever arm sub-assembly and transported by said lever arm sub-assembly, and rack means mounted to said roller linkage sub-assembly and driven by said roller linkage sub-assembly.

11. A moveable cart as claimed in claim 10 wherein said lever arm sub-assembly comprises a yoke shaped lever member with pedal means on one end, and connector bar means on the other end, said yoke member being adapted to be mounted to said frame for pivotable movement on said frame.

12. A moveable cart as claimed in claim 10 wherein said roller linkage sub-assembly comprises a transfer bar and a plurality of pivot arms mounted to said transfer bar, said pivot arms being angularly shaped with roller means rotatably mounted on one end thereof.

13. A moveable cart as claimed in claim 12 wherein said roller means comprises a nylon roller member.

14. A moveable cart as claimed in claim 7 wherein said rack means comprises two members connected to said lifting means, each of said members defining a rack section thereon and a channel forming structure which is adapted to receive rack supports secured to the bottom of said cart deck, one end of each of said rack members being supported by a support member.

15. A moveable cart as claimed in claim 7 including release means, said release means being adapted to release said locking members from their engagement against said structure, so that said locking members move downwardly through said deck aperture.

16. A moveable cart as claimed in claim 15 wherein said release means comprises a pedal member pivotably mounted to said deck, said pedal member having a pedal extending outside of said deck adapted to be engaged by an individual and a release member projecting into the interior of said deck to release the end of said rack means from a locked engagement.

17. A moveable cart as claimed in claim 7 wherein said locking members comprise a plurality of rotatable members defining a plurality of teeth, said members comprising a driver member and a driven member, said driven member being provided with gear teeth which matably engage said rack and are driven by said rack, and gear teeth which matably engage the teeth of said driven member to drive said member when acted upon by said rack.

18. A moveable cart as claimed in claim 7 wherein said deck is an integral moulded shell with a plurality of bosses projecting inwardly, said bosses being adapted to receive screw means for holding rack support means and said locking means.

19. A moveable cart as claimed in claim 7 wherein said handle comprises a plurality of bars mounted in said deck, said bars each being provided with a removable knuckle at one end, said knuckle being adapted to receive and hold a support bar mounted therein.

20. A locking mechanism for locking a structure in a fixed position on a platform, comprising a platform, a plurality of rotatable members mounted to said platform, said members comprising at least a driver member and a driven member, said driven member being provided with gear teeth which mateably engage a rack means positioned adjacent to said platform and gear teeth provided on said rack means which mateably engage said teeth of the driven member to drive each said driven member above the planar surface of the platform against the walls of said structure to hold said structure in a fixed position on said platform.

21. A locking mechanism as claimed in claim 20 wherein said platform defines an aperture and said locking members are disposed beneath said aperture and are adapted to be driven upward through said aperture to engage the walls of said structure.

22. A locking mechanism as claimed in claim 20 wherein said platform has a plurality of bosses extending downward from its lower surface and defines a plurality of seats on its lower surface, said locking members being rotatably mounted in said seats and said rack means being slideably mounted on said bosses.

23. A locking mechanism as claimed in claim 20 wherein said driver member and driven member comprise a shaft, a semi-circular body structure mounted on said shaft, the outside of said semi-circular body structure defining a plurality of teeth and a plurality of guides positioned along said shaft adjacent said teeth.

* * * * *